United States Patent [19]

Barnhart

[11] Patent Number: 4,787,753

[45] Date of Patent: Nov. 29, 1988

[54] LEAF HOOPS

[76] Inventor: William D. Barnhart, 629 Ransom St., Ripon, Wis. 54971

[21] Appl. No.: 871,928

[22] Filed: Jun. 9, 1986

[51] Int. Cl.[4] ..... B65D 33/02

[52] U.S. Cl. ..... 383/33; 141/390

[58] Field of Search ..... 383/33; 141/390; 248/99, 101; 15/257.1, 257.9

[56] References Cited

U.S. PATENT DOCUMENTS

| | | | |
|---|---|---|---|
| 569,830 | 10/1896 | Hunt | 15/257.9 |
| 2,421,740 | 6/1947 | Birch, Jr. | 248/101 |
| 2,462,973 | 3/1949 | Kelrick | 248/101 |
| 3,426,958 | 2/1969 | Gore | 383/33 |
| 3,697,030 | 10/1972 | Schultz | 15/257.1 |
| 3,744,081 | 7/1973 | Miller | 248/101 |
| 3,747,653 | 7/1973 | Ringer | 15/257.1 |
| 3,861,630 | 1/1975 | Ady | 248/101 |
| 3,893,649 | 7/1975 | Cornell et al. | 383/33 |
| 4,084,691 | 9/1977 | Spangler | 15/257.1 |
| 4,550,440 | 10/1985 | Rico | 383/33 |

*Primary Examiner*—Stephen P. Garbe

*Attorney, Agent, or Firm*—Donald Cayen

[57] ABSTRACT

A pair of thin walled and nestable trapezoidal hoops have peripheral lengths approximately equal to the peripheral length of a commercial leaf bag near the free edge thereof. The leaf bag is inserted through the inner hoop and the free edge of the bag is folded back over the inner hoop. The outer hoop is nested over the inner hoop, thereby capturing the bag between the hoops and holding the mouth of the bag open. The hoops and bag can then be placed vertically on the ground with the short top section of the hoops serving as a handle gripable with one hand. Leaves can then be horizontally raked into the open bag with the second arm and hand.

4 Claims, 1 Drawing Sheet

LEAF HOOPS

BACKGROUND OF THE INVENTION

1. Field of the Invention

This invention pertains to lawn and garden apparatus, and more particularly to apparatus for bagging leaves and similar items raked from the ground.

2. Description of the Prior Art

A reoccurring situation associated with lawn and garden work is the handling of leaves, cut grass, and related materials. It is one task to rake the leaves and grass into a pile. It is a separate job to dispose of the pile of leaves and grass.

It is well known to pack raked leaves into commercially available plastic leaf bags. However, the packing job is easier said than done. The bag walls have essentially no compressive strength. As a consequence, it is a cumbersome and frustrating operation for the gardener to hold the mouth of the bag open, because the bag droops limply toward the ground wherever it is not supported. The gardener is forced to use his arms and elbows to try to keep the bag mouth open for accepting the leaves while simultaneously trying to stuff the leaves into the bag. Consequently, the leaf bagging portion of total lawn care work is disproportionately high in both time and energy consumption.

Loading a leaf bag is much easier when a second person holds the bag mouth open while the first person fills the bag. However, a second person is often not available to help, and even if he is, it is not efficient to require two persons to load a light weight plastic bag.

Thus, a need exists for means that aid in loading raked yard materials into leaf bags.

SUMMARY OF THE INVENTION

In accordance with the present invention, apparatus is provided that greatly facilitates the loading of raked leaves and grass into large plastic bags. This is accomplished by apparatus that includes a pair of thin walled hoops that are designed to retain the mouth of a plastic bag in an open configuration.

The hoops are dimensioned such that they are nestable with each other, with approximately 0.010 inches clearance between the inner periphery of the outer hoop and the outer periphery of the inner hoop. The lengths of the outer periphery of the inner hoop and the inner periphery of the outer hoop are approximately equal to the periphery of a standard commercially available plastic leaf bag. Preferably, the hoops are of trapezoidal shape with a relatively long base section and a relatively short top section. The preferred material for the hoops is a light weight, durable, and slightly flexible plastic. The width of the hoops is desirably about 1.25 inches to 1.50 inches.

The hoops of the present invention are used by opening a leaf bag and inserting it through the inner hoop such that the opened free edge of the bag generally conforms to and is a few inches from the inner hoop. The bag edge is folded back over the inner hoop, which may require a slight stretching of the bag wall. Then the outer hoop is slipped over the inner hoop and the folded over bag edge to capture the bag edge between the two hoops and thereby prevent the bag from sliding off the inner hoop. As a result, the bag mouth is retained open by the hoops. The gardener places the hoop base on the ground. The short top section serves as a handle for gripping with one hand, and the gardener's second hand and arm are free to rake the leaves horizontally into the open bag.

Other aims and advantages of the invention will become apparent to those skilled in the art from reading the detailed disclosure of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
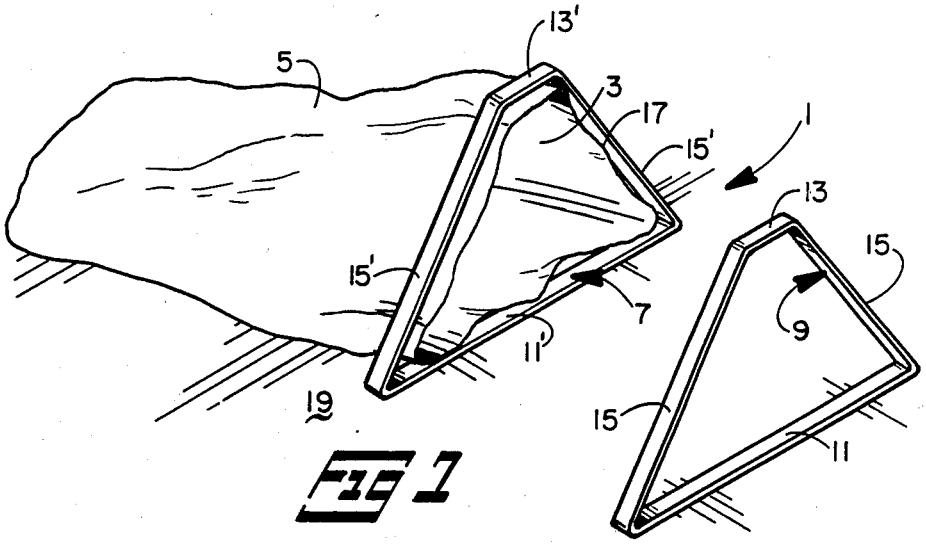
FIG. 1 is a perspective view of the leaf hoops of the present invention in conjunction with a conventional leaf bag.

Referring to FIG. 1, a pair of leaf hoops 1 is illustrated that includes the present invention. The leaf hoops are particularly useful for holding open the mouth 3 of a conventional plastic leaf bag 5, but it will be understood that the invention is not limited to yard and garden applications.

The leaf hoops 1 comprise an inner hoop 7 and an outer hoop 9. The outer hoop 9 is nestable over the inner hoop 7 to capture the free edge 17 of a bag 5 therebetween. The hoops may be of any suitable shape, such as round or square, but the preferred shape is trapezoidal. The hoops may be made from any suitable material. A preferred material is a low cost and slightly flexible polyproplene plastic. That material is easily molded or formed into the desired shape.

To enable the bag 5 to be captured between the nested hoops 7 and 9, the hoops are dimensioned such that there is approximately 0.01 inches of uniform clearance between the outer periphery of the inner hoop and the inner periphery of the outer hoop when the two hoops are nested together. The lengths of the outer periphery of the inner hoop and the inner periphery of the outer hoop are approximately equal to the peripheral length of the wall of the leaf bag adjacent the edge thereof. I have found that the hoops best achieve their intended purpose when the inner surface of the base section 11 on the outer hoop is approximately 25.5 inches long. Similarly, the preferred length of the inner surface of the top section 13 is about 5 inches. Those two dimensions dictate that the length of the two side sections 15 be approximately 17.75 inches long. The lengths of the corresponding base section 11', top section 13', and side sections 15' on the inner hoop are dimensioned such that when the inner hoop is nested within the outer hoop, approximately 0.01 inches clearance exists between the corresponding hoop sections.

In addition, a tradeoff between heavy and rugged hoops suitable for extended outdoor use and light hoops for easy manipulation requires that the hoops made from the preferred plastic material have rather closely defined widths and thicknesses. The hoops 7 and 9 best achieve their desired functions with a wall thickness of about 0.09 inches to 0.10 inches and a width of about 1.25 inches to 1.5 inches.

Figure 2:
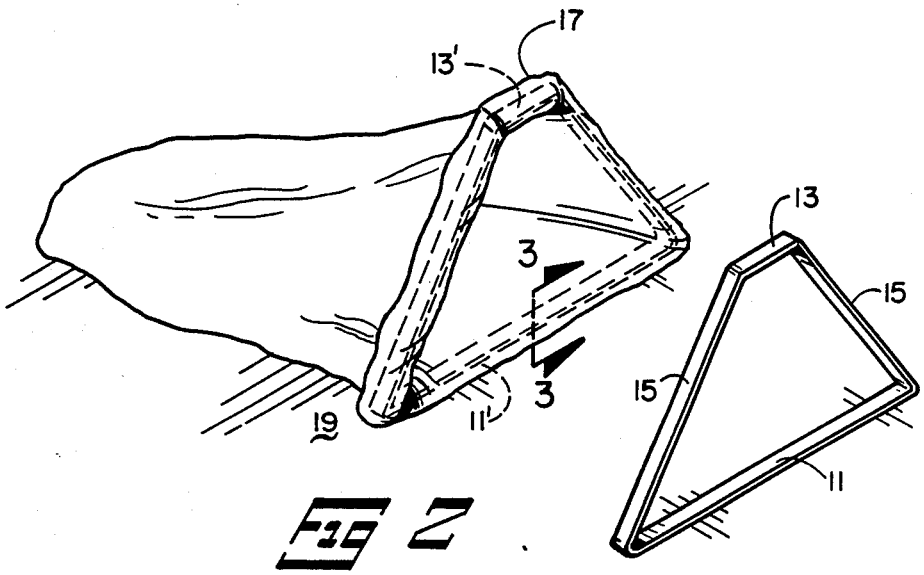
FIG. 2 is a perspective view of the leaf hoops of the present invention showing the hoops about to be nested together to capture the edge of the leaf bag therebetween.
Figure 3:
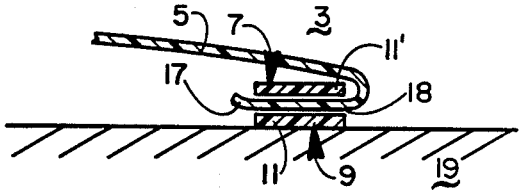
FIG. 3 is a sectional view taken generally along lines 3—3 of FIG. 2, but showing the base sections of the leaf hoops nested together to capture a portion of the leaf bag edge.

To use the leaf hoops 1 of the present invention, the inner hoop 7 and outer hoop 9 are disassembled. An ordinary leaf bag 5 is inserted through the opening in the inner hoop. The bag is partially opened to create the mouth 3. The bag is positioned within the inner hoop such that the bag edge 17 generally conforms to and extends one or two inches beyond the inner hoop, FIG. 1. Next, the bag edge 17 is folded back over the outer periphery of the inner hoop, FIG. 2. With an inner hoop of the dimensions previously given, the bag wall may stretch slightly when the edge is folded back over the inner hoop. The outer hoop is then nested over the inner hoop, thereby capturing the bag edge in the uniform 0.01 inches of clearance 18 between the base 11, top 13, and sides 15 of the outer hoop and the respective sections 11', 13', and 15' of the inner hoop, FIG. 3. In FIG. 3, the clearance 18 and also the spacings between the hoops, leaf bag, and ground 19 are shown exaggerated for clarity.

With the bag mouth 3 retained in the open position by the hoops 1, the base sections 11, 11' are set on the ground 19. The top sections 13, 13' may be used as handles which the gardener grips with one hand. Consequently, the gardener has full use of his second arm and hand to rake leaves, grass, and related materials into the bag 5 through the open mouth.

When the bag 5 is full, it is a simple matter to disassemble the hoops 1 by sliding the outer hoop 9 out of nesting engagement with the inner hoop 7. The bag edge 17 is unfolded from the inner hoop to permit the bag mouth 3 to be closed and tied. The two hoops are immediately ready to cooperate with each other to hold open another bag 5 for filling.

Thus, it is apparent that there has been provided, in accordance with the invention, leaf hoops that fully satisfy the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. Apparatus for holding open a flexible bag comprising:

a. an outer member formed into a closed hoop having a predetermined inner periphery and a predetermined wall thickness and a predetermined width; and b. an inner member formed into a closed hoop having a predetermined outer periphery, the inner member being freely passable completely through the outer member and being selectively nestable within the outer member to create a generally uniform clearance of about 0.01 inches between the outer periphery of the inner member and the inner periphery of the outer member, the inner member having a predetermined wall thickness and a predetermined width, so that the two members may cooperate to loosely retain the periphery of the flexible bag near the free edge thereof in the clearance between the members when the members are nested together.

2. The apparatus of claim 1 wherein:

a. the inner and outer members are formed into closed hoops having a trapezoidal shape with base, top, and side sections; and b. the outer periphery of the inner hoop base section of the trapezoid is approximately 25.5 inches long, and the outer periphery of the inner hoop top section is approximately 5 inches long, and the outer peripheries of the inner hoop side sections are approximately 17.75 inches long.

3. Apparatus for receiving leaves and similar yard material comprising:

a. a bag made of thin flexible material and having a mouth defined by a free edge of bag material, the bag having a wall with a predetermined peripheral length adjacent the free edge;

b. an inner member formed into a closed hoop having an outer periphery with a peripheral length approximately equal to the periphery of the bag wall adjacent the free edge of the bag, the inner member having a predetermined wall thickness and a predetermined width, the inner member being made from a slightly flexible plastic material; and c. a slightly flexible plastic outer member formed into a closed hoop that is freely and completely passable over the inner member and having an inner periphery selectively nestable over the inner member outer periphery to create a generally uniform clearance of approximately 0.01 inches between the outer periphery of the inner member and the inner periphery of the outer member, the outer member having a predetermined wall thickness and width, the wall of the flexible bag near the free edge thereof being interposed in the clearance between the inner and outer members, so that the flexible bag is loosely retained in the clearance between the inner and outer members to hold the mouth of bag open and thereby aid in filling the bag with leaves.

4. The apparatus of claim 3 wherein:

a. the inner and outer members are formed into closed hoops having a trapezoidal shape with base, top, and side sections, and b. the outer periphery of the inner hoop base section of the trapezoid is approximately 25.5 inches long, the outer periphery of the inner hoop top section is approximately 5 inches long, and the outer peripheries of the inner hoop side sections are approximately 17.75 inches long, so that the base section of the hoops may be placed on the ground and the top section may be conveniently gripped by the person filling the bag.

* * * * *